US007208253B2

(12) United States Patent
Mayer et al.

(10) Patent No.: US 7,208,253 B2
(45) Date of Patent: Apr. 24, 2007

(54) TONER COMPOSITION

(75) Inventors: Fatima M. Mayer, Mississauga (CA); Guerino G. Sacripante, Oakville (CA); Edward G. Zwartz, Mississauga (CA); Nicoleta Mihai, Oakville (CA); Enno E. Agur, Toronto (CA)

(73) Assignee: Xerox Corporation, Stamford, CT (US)

( * ) Notice: Subject to any disclaimer, the term of this patent is extended or adjusted under 35 U.S.C. 154(b) by 158 days.

(21) Appl. No.: 10/777,397

(22) Filed: Feb. 12, 2004

(65) Prior Publication Data

US 2005/0186496 A1 Aug. 25, 2005

(51) Int. Cl.
*G03G 9/087* (2006.01)

(52) U.S. Cl. ..... 430/108.2; 430/109.4

(58) Field of Classification Search ..... 430/108.2, 430/109.4
See application file for complete search history.

(56) References Cited

U.S. PATENT DOCUMENTS

| | | | | | |
|---|---|---|---|---|---|
| 4,076,641 | A | * | 2/1978 | Scouten et al. | 430/108.2 |
| 5,278,020 | A | | 1/1994 | Grushkin et al. | 430/137 |
| 5,290,654 | A | | 3/1994 | Sacripante et al. | 430/137 |
| 5,308,734 | A | | 5/1994 | Sacripante et al. | 430/137 |
| 5,348,832 | A | | 9/1994 | Sacripante et al. | 430/109 |
| 5,567,563 | A | * | 10/1996 | Minami | 430/108.4 |
| 5,593,807 | A | | 1/1997 | Sacripante et al. | 430/137 |
| 5,604,076 | A | | 2/1997 | Patel et al. | 430/137 |
| 5,658,704 | A | | 8/1997 | Patel et al. | 430/137 |
| 5,858,601 | A | | 1/1999 | Ong et al. | 435/137 |
| 5,863,698 | A | | 1/1999 | Patel et al. | 430/137 |
| 5,925,488 | A | | 7/1999 | Patel et al. | 430/137 |
| 5,977,210 | A | | 11/1999 | Patel et al. | 523/161 |
| 6,017,671 | A | * | 1/2000 | Sacripante et al. | 430/108.8 |
| 6,140,003 | A | * | 10/2000 | Sacripante et al. | 430/108.22 |
| 6,156,473 | A | * | 12/2000 | Tyagi et al. | 430/108.2 |
| 6,500,594 | B2 | * | 12/2002 | Hamano et al. | 430/109.4 |
| 2004/0192548 | A1 | * | 9/2004 | Hara | 503/201 |

FOREIGN PATENT DOCUMENTS

| | | | |
|---|---|---|---|
| JP | 06180511 | A * | 6/1994 |
| JP | 08234478 | A * | 9/1996 |

* cited by examiner

*Primary Examiner*—Christopher RoDee
(74) *Attorney, Agent, or Firm*—Eugene O. Palazzo; Fay Sharpe LLP

(57) ABSTRACT

A toner containing a mixture of a sulfopolyester resin, a colorant and an alkyl amide.

11 Claims, No Drawings

TONER COMPOSITION

BACKGROUND AND SUMMARY

The present invention is generally directed to toner compositions, and more specifically, to toner compositions comprised of a sulfopolyester resin, colorant and an alkylamide such as a stearyl stearamide or a stearyl erucamide. In embodiments, the present invention is generally directed to a toner composition comprised of a sulfopolyester resin, a colorant, and an alkyl amide wherein alkyl contains, for example, from about 10 to about 100 carbon atoms and an economical in situ, chemical process for the preparation of toners comprised of a sulfopolyester resin, a colorant, and alkyl amide, and which process is, for example, comprised of mixing an aqueous based emulsion of a sulfopolyester resin, an aqueous colorant dispersion and an aqueous alkyl amide dispersion of, for example, equal to or less than about 1 micron in diameter followed by heating the resulting mixture with a coagulant, such as a multivalent metal salt, to afford a toner.

Advantages associated with the toner compositions, in embodiments, disclosed herein include low melt properties of from about 120° C. to about 145° C., with high gloss and excellent release, especially release from oil-less fusers wherein images are generated by reprographic processes, and wherein the toner image is fused onto paper utilizing a fuser in the absence of an oil or release agent coating the fuser oil, and thereby generating images with a gloss, such as for example, from about 50 to about 90 gloss units as measured using the Gardner Gloss metering unit. Also, the toner compositions of the present invention display in embodiments thereof an average volume diameter of, for example, from about 1 to about 25, and preferably from about 3 to about 10 microns, and a narrow GSD of, for example, from about 1.16 to about 1.26 or about 1.18 to about 1.28, both as measured on the Coulter Counter; a particle morphology which is dependant on the particle generation process, and is from irregular shapes to nearly spherical in shape when prepared by the chemical processes illustrated herein. One chemical process, in embodiments, enables the utilization of polymers obtained by polycondensation reactions, such polymers including, for example, sulfopolyester resins, and more specifically, the sulfonated polyesters as illustrated in U.S. Pat. Nos. 5,348,832; 5,658,704; 5,604,076 and 5,593,807, the disclosures of each of which are totally incorporated herein by reference.

The toners of the present invention can be selected for known electrophotographic imaging methods, printing processes including color processes, digital methods, and lithography.

REFERENCES

In xerographic or electrostatographic printers, a charge-retentive member is charged to a uniform potential and thereafter exposed to a light image of an original document to be reproduced. The exposure discharges the charge-retentive surface in exposed or background areas and creates an electrostatic latent image on the member which corresponds to the image areas contained within the original document. Subsequently, the electrostatic latent image on the charge-retentive surface is rendered visible by developing the image with developing powder. Many development systems employ a developer material which comprises both charged carrier particles and charged toner particles which triboelectrically adhere to the carrier particles. During development, the toner particles are attracted from the carrier particles by the charge pattern of the image areas on the charge-retentive area to form a powder image on the charge-retentive area. This image is subsequently transferred to a sheet, to which it is permanently affixed by heating or by the application of pressure. One approach to fixing the toner image is by applying heat and pressure by passing the sheet containing the unfused toner images between a pair of opposed roller members, at least one of which is internally heated. During this procedure, the temperature of the toner material is elevated to a temperature at which the toner material coalesces and becomes tacky. This heating causes the toner to flow to some extent into the fibers or pores of the sheet. Thereafter, as the toner material cools, solidification of the toner material causes the toner material to become bonded to the support member. Typical of such fusing devices are two roll systems wherein the fuser roll is coated with release fluids such as silicone based oils, which oils are applied to the surface of the silicone rubber. The use of release agents in toners can result in poor gloss properties, low projection efficiencies, and degradation in toner flow properties.

Polyester based chemical toners are known, for example reference U.S. Pat. No. 5,593,807, the disclosure of which is totally incorporated herein by reference, wherein there is illustrated a process for the preparation of a toner comprised of a sodiosulfonated polyester resin and pigment, and wherein the aggregation and coalescence of resin particles is mediated with an alkali halide. Other U.S. Patents that may be of interest, the disclosures of which are totally incorporated herein by reference, are U.S. Pat. Nos. 5,853,944; 5,843,614; 5,840,462; 5,604,076; 5,648,193; 5,658,704 and 5,660,965.

Emulsion/aggregation/coalescing processes for the preparation of toners are illustrated in a number of Xerox patents, the disclosures of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797. Also of interest may be U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,910,387; 5,919,595; 5,916,725; 5,902,710; 5,863,698, 5,925,488; 5,977,210 and 5,858,601.

There is a need for high gloss toner prints and a need for toners that are functional in xerographic engines with an economical fusing apparatus, such as oil-less fuser apparatus. Also, there is a need for toner compositions that are functional in oil-less fuser apparatus in the absence of a wax, and there is a further need for toner compositions for oil-less fusing applications which provide low minimum fixing temperatures, such as from about 120° C. to about 140° C. with a broad fusing latitude such as from about 30° C. to about 45° C., wherein the fusing latitude is considered the difference between the minimum fixing temperature and the temperature at which the toner offsets to the fusing member, and with high image gloss properties, such as from about 50 to about 95 gloss units as measured by the Gardner Gloss metering unit; high projection efficiency, such as from about 75 to about 90 percent transmission; excellent powder flow properties, such as less than about 30 percent cohesion, and excellent admix characteristics as indicated herein, and wherein the toner maintains its triboelectric charging characteristics for an extended number of imaging cycles up to, for example, 1,000,000 in a number of embodiments. These, and other needs can be provided in embodiments with the toner compositions illustrated herein.

EMBODIMENTS

It is a feature of the present invention to provide dry toner compositions comprised of a resin, a colorant and an alkyl amide.

In another feature of the present invention there are provided toner compositions comprised of a resin, a colorant and an alkyl amide, and wherein high gloss images are obtained of from about 50 to about 95 gloss units as measured with a Gardner gloss metering unit.

Additionally, it is another feature of the present invention to provide a toner composition, useful in xerographic device equipped with a fuser apparatus containing no oil.

In a further feature of the present invention there are provided toners with enhanced charging performance characteristics, such as triboelectric charging levels at both low and high humidity zones (20 percent and 80 percent relative humidity, respectively), minimized RH sensitivity, and narrow charge distributions determined by the half-width on the known charge spectrograph.

Also, in another feature of the present invention there are provided toner particles with excellent fusing characteristics for digital color printing applications, low fusing temperatures of from about 130° C. to about 150° C., broad fusing latitude, such as from about 60° C. to about 90° C., and low vinyl offset.

In further features of the present invention there is provided a chemical process for the preparation of toner size particles with, for example, an average volume diameter of from about 3 to about 10 microns with a narrow GSD of from about 1.18 to about 1.26; processes for the preparation of toner compositions which possess a spherical morphology, a non-spherical morphology, or mixtures thereof, with a toner average particle volume diameter of from about 1 to about 20 microns, and preferably from about 1 to about 9 microns, and with a narrow GSD of from about 1.12 to about 1.30, and more specifically, from about 1.14 to about 1.25, each as measured with a Coulter Counter; toner compositions with excellent blocking characteristics of from about 50° C. to about 60° C., and preferably from about 55° C. to about 60° C.; toner compositions with a high projection efficiency, such as from about 75 to about 95 percent efficiency as measured by the Match Scan II spectrophotometer available from Milton-Roy; toner compositions which result in minimal, low, or no paper curl; and a toner chemical process comprising (i) preparing an aqueous dispersion of an alkyl amide utilizing an homogenizer; (ii) preparing a colloidal solution of a sulfonated polyester resin by heating in water, (iii) mixing the colloidal sulfopolyester emulsion with the alkyl amide dispersion and a colorant; (iv) heating the mixture to a temperature of from about 50° C. to about 60° C. with stirring, and adding thereto an aqueous solution of either an alkaline earth metal (II) salt or a transition metal salt whereby the coalescence and ionic complexation of the sulfonated polyester colloid, colorant, alkyl amide and metal cation occur until the particle size of the composite is about 3 to about 25 microns in volume average diameter with a geometric distribution of from about 1.13 to about 1.23.

Aspects featured herein relate to a toner comprised of a sulfopolyester resin, a colorant and an alkyl amide; a toner comprised of a polymer, colorant and an alkyl amide of the formula

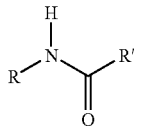

wherein R is a hydrogen atom, an aliphatic saturated hydrocarbon or an unsaturated hydrocarbon, each optionally with, for example, from about 2 to about 100 carbon atoms, and R' is an aliphatic saturated hydrocarbon or an unsaturated hydrocarbon, each optionally with, for example, from about 2 to about 100 carbon atoms; a composition comprised of a sulfopolyester resin, a colorant and an alkyl amide, and wherein the composition, such as a toner, is prepared by a chemical process such as an emulsion coalescence process, and which process is comprised of (i) subjecting a colloidal aqueous solution comprised of, for example, about 10 to about 20 percent solids of, for example, sodio-sulfonated polyester resin particles, water, a colorant of from about 3 to about 18 percent by weight of toner and an aqueous dispersion comprised of, for example, about 10 to about 20 percent solids of, for example, alkyl amide particles adding to the resulting mixture (i) a coalescence agent as illustrated in U.S. Pat. No. 5,593,807, the disclosure of which is totally incorporated herein by reference, comprised, for example, of zinc acetate; and heating the resulting mixture to a temperature of from about 50° C. to about 65° C. to afford toner particles of from about 1 to about 30, and more specifically, from about 5 to about 8 microns in volume average diameter; (iii) followed by removal of the toner from water by filtration, washing and drying, and wherein there results toners comprised of a sulfopolyester resin, colorant and an alkyl amide of the formula

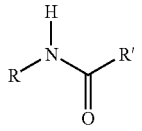

wherein R is a hydrogen atom, an aliphatic saturated or unsaturated hydrocarbon with, for example, from about 2 to about 100, or from about 10 to about 40 carbon atoms, and R' is an aliphatic saturated or unsaturated hydrocarbon with, for example, from about 2 to about 100, or from about 10 to about 40 carbon atoms; a toner containing a suitable resin, such as a sulfonated polyester resin, a colorant and an alkyl amide, and which toners can be generated by conventional melt kneading and pulverization processes or by the chemical processes of, for example, U.S. Pat. Nos. 5,348,832; 5,853,944; 5,840,462; 5,660,965; 5,658,704; 5,648,193 and 5,593,807, the disclosures of each patent being totally incorporated herein by reference; a toner comprised of resin, such as a polyester resin, a styrene acrylate resin, a styrene-butadiene resin, a styrene-methacrylate resin, a sulfonated styrene-(meth)acrylate resin, and preferably, a sulfonated polyester resin, colorant, and an alkyl amide, and wherein the sulfopolyester resin is of the formula

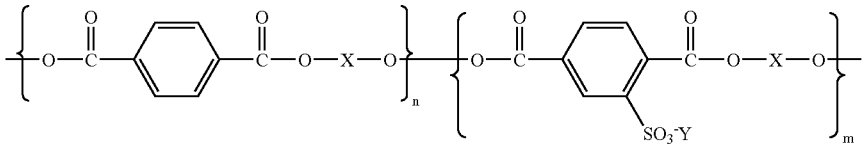

wherein Y is an alkali metal, such as sodium, lithium or potassium; X is a glycol; n and m each represent the number of segments; and the alkyl amide is of the formula

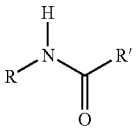

wherein R is a hydrogen atom, or an aliphatic saturated or unsaturated hydrocarbon, and R' is an aliphatic saturated or unsaturated hydrocarbon.

The alkylamide typically comprises, for example, a primary or secondary monoamide, but is preferably a secondary monoamide, or mixtures thereof. Of the primary monoamides, stearamide, such as KEMAMIDE™ S, manufactured by Witco Chemical Company, can be selected. The secondary monoamide can be behenyl behenamide (KEMAMIDE™ EX666), stearyl stearamide (KEMAMIDE™ S-180), or KEMAMIDE™ EX-672), all available from Witco Chemical Company. However, stearyl stearamide I, or the stearyl erucamide II can also be selected

I

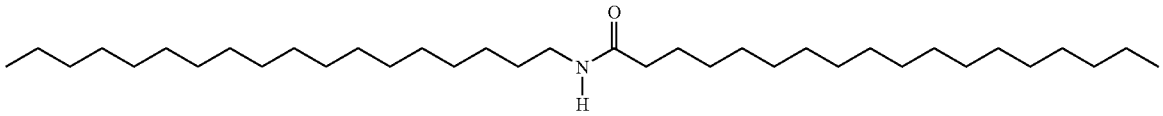

II

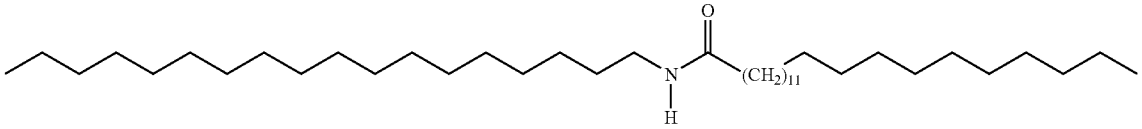

The melting point of the alkyl amides are, for example, at least about 70° C., and more specifically, at least about 80° C., and yet more specifically, less than about 140° C., such as from about 70° C. to about 150° C., and more specifically, from about 90° C. to about 125° C. The molecular weight $M_w$ of the alkyl amides are, for example, from about 90 to about 1,000 grams per mole, and more specifically, from about 300 to about 800 grams per mole.

The toner process in specific embodiment comprises (i) preparing an aqueous dispersion of an alkyl amide, such as stearyl stearamide (20 nominal weight percent) with NEOGEN™ RK anionic surfactant (Daichi Kogyo Seiyaku Co. Ltd., Japan) at about 2.5 pph surfactant utilizing a Gaulin 15MR homogenizer at 120° C. and 8,000 psi for 60 minutes to result in a dispersion with a solids content of about 20 percent and a particle size of about 188 nanometers; (ii) preparing a colloidal solution of a sulfonated polyester resin by heating water at a temperature of from about 75° C. to about 95° C., adding thereto a sulfonated polyester resin, and cooling; (iii) mixing the colloidal sulfopolyester emulsion with the alkyl amide dispersion and a colorant; (iv) heating the resulting mixture to a temperature of from about 50° C. to about 60° C. with stirring, and adding thereto an aqueous solution of either an alkaline earth metal (II) salt or a transition metal salt whereby the coalescence and ionic complexation of the sulfonated polyester colloid, colorant, alkyl amide and metal cation occur until the particle size of the composite is about 3 to about 15 microns in volume average diameter with a geometric distribution of from about 1.13 to about 1.23, wherein the wet toner solids of about 3 to about 10 microns in size are redispersed in water thereby forming a slurry of about 15 to about 25 percent by weight of toner solids; and (v) followed by filtration, washing with water, and drying.

Examples of alkyl amides include primary, or secondary monoamides, and mixtures thereof as illustrated herein. Examples, of primary amides are stearamide, such as KEMAMIDE™ S, manufactured by Witco Chemical Company, ethylamide, propylamide, butylamide, pentylamide, hexylamide, cyclohexylamide, octylamide, dodecylamide, hexadecylamide, octadecylamide, oleamide, eucamide, and behenamide. Secondary monoamide examples are, behenyl benenamide (KEMAMIDE™ EX-666), stearyl stearamide (KEMAMIDE™ S-180), stearyl oleamide, stearyl eucamide, eucryl stearamide, behenyl behenamide, ethylene bis(oleamide), ethylene bis(stearamide), and the like. The alkyl amide can be selected in various effective amounts, such as an amount of from about 5 to about 40 percent by weight of toner and preferably from about 10 to about 30 percent by weight of toner.

Examples of sulfopolyester resins are as indicated herein and in the appropriate U.S. patents recited, and more specifically, examples of a number of sulfopolyesters are the sodium or lithium salt of copoly(1,2-propylene-dipropylene- 5-sulfoisophthalate)-copoly(1,2-propylene-dipropylene terephthalate), copoly(1,2-propylene-diethylene-5-sulfoisophthalate)-copoly (1,2-propylene-diethylene terephthalate), copoly(1,2-dipropylene-5-sulfoisophthalate)-copoly (1,2-propylene terephthalate), copoly(1,3-butylene-5-sulfoisophthalate)-copoly(1,3-butylene terephthalate), copoly(1,2-dipropylene-5-sulfoisophthalate)-copoly(1,2-propylene terephthalate), copoly(1,3-butylene-5-sulfoisophthalate)-copoly(1,3-butylene terephthalate), copoly(1,2-propylene-diethylene-5-sulfoisophthalate)-copoly(1,2-propylene-diethylene terephthalate), and wherein the resins are characterized with a number average molecular weight of from about 2,000 to about 100,000 grams per mole, or about 20,000 to about 75,000 grams per mole, a weight average molecular weight, or from about 25,000 to about 125,000 or from about 4,000 grams per mole to about 250,000 grams per mole, and a polydispersity of from about 1.8 to about 17, all as measured by gel permeation chromatography. The sulfopolyester resin is selected in an amount of from about 70 to about 95 percent by weight of toner, and more specifically, from about 75 to about 90 percent by weight of toner.

Examples of the alkali (II) salts that can be selected to primarily coalesce the generated sodiosulfonated polyester colloid with a colorant and alkyl amide dispersions include alkali (II) halides like beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, or mixtures thereof, and the concentration thereof is, for example, from about 0.1 to about 5, and more specifically, from about 1 to about 2 weight percent of water.

Various known colorants, especially pigments, present in the toner in an effective amount of, for example, from about 1 to about 25, and more specifically, from about 2 to about 15 percent by weight of the toner, and yet more specifically, in an amount of from about 1 to about 15 weight percent, and wherein the total of all toner components is about 100 percent, include carbon black like REGAL 330®; magnetites such as Mobay magnetites MO8029™, MO8060™; and the like. As colored pigments, there can be selected known cyan, magenta, yellow, red, green, brown, blue or mixtures thereof. Specific examples of colorants, especially pigments, include phthalocyanine HELIOGEN BLUE L6900™, D6840™, D7080™, D7020™, cyan 15:3, magenta Red 81:3, Yellow 17, the pigments of U.S. Pat. No. 5,556,727, the disclosure of which is totally incorporated herein by reference, and the like. Examples of specific magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of specific cyans that may be selected include copper tetra (octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative specific examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. The colorants, such as pigments, selected can be flushed pigments as indicated herein.

A number of specific colorant examples include Pigment Blue 15:3 having a Color Index Constitution Number of 74160, magenta Pigment Red 81:3 having a Color Index Constitution Number of 45160:3, and Yellow 17 having a Color Index Constitution Number of 21105, and known dyes such as food dyes, yellow, blue, green, red, magenta dyes, and the like.

Colorants include pigments, dyes, mixtures of pigments, mixtures of dyes, mixtures of dyes and pigments, and the like, and more specifically pigments.

Dry powder additives that can be added or blended onto the surface of the toner compositions after washing or drying include, for example, metal salts, metal salts of fatty acids, colloidal silicas, metal oxides like titanium, tin and the like, mixtures thereof and the like, which additives are each usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and flow aids, such as fumed silicas like AEROSIL R972® available from Degussa, or silicas available from Cabot Corporation or Degussa Chemicals; the coated silicas of U.S. Pat. No. 6,190,815 and U.S. Pat. No. 6,004,714, the disclosures of each patent being totally incorporated herein by reference, and the like, each additive being present, for example, in amounts of from about 0.1 to about 2 percent, and which additives can be added during aggregation process or blended into the formed toner product.

Developer compositions can be prepared by mixing the toners with known carrier particles, including coated carriers, such as steel, ferrites, and the like, reference U.S. Pat. Nos. 4,937,166 and 4,935,326, the disclosures of which are totally incorporated herein by reference, at, for example from about 2 percent toner concentration to about 8 percent toner concentration.

Imaging methods are also envisioned with the toners of the present invention, reference for example a number of the patents mentioned herein, and U.S. Pat. No. 4,265,990, the disclosure of which is totally incorporated herein by reference.

The following Examples are being submitted to further define various species of the present invention. These Examples are intended to be illustrative only and are not intended to limit the scope of the present invention. Also, parts and percentages are by weight unless otherwise indicated.

EXAMPLE I

Preparation of an Aqueous Dispersion of Stearyl Stearamide with a Volume Median Diameter of 188 Nanometers, and Stabilized with an Anionic Surfactant:

2,771 Grams of deionized water, 258.2 grams of a 7.45 percent anionic surfactant solution containing about 19.3 grams of primarily NEOGEN™ R-K branched sodium dodecyl benzene sulfonate (Daiichi Kogyo Seiyaku Co. Ltd., Japan), and adding thereto about 770.5 grams of KEMAMIDE™ S-180 stearyl stearamide wax (Witco, USA) having an onset and peak melting point of about 89°

C. and about 95° C., respectively, were introduced into a 1 gallon reactor. The reactor feed port was closed and the reactor agitator was set to operate at about 400 revolutions per minute. The above wax mixture was subjected to steam heating in the reactor jacket to a set temperature of about 120° C. to melt the wax. When the set temperature had been reached, the discharge valve to the Gaulin 15MR homogenizer (APV Homogenizer Group, USA) was opened and the homogenizer was turned on to pump the wax mixture through the homogenizer. Initially, the homogenizer primary valve was retained in an open position, and the secondary valve was partially closed to generate a pressure drop of about 7 megapascals through the valve as read from a pressure gauge mounted on the homogenizer to pre-emulsify the wax mixture for about 30 minutes. Then the homogenizer primary valve was partially closed to generate a pressure drop of about 55 megapascals through the valve to emulsify the pre-emulsified wax mixture for about 60 minutes. During the pre-dispersion and the dispersion, the wax mixture temperature as measured in the reactor with a thermocouple was maintained at about 120° C. On the completion of emulsification, the homogenizer primary and secondary valves were opened, the homogenizer was disengaged, the emulsified product in the reactor was cooled by means of water in the reactor jacket to a safe temperature of less than about 40° C., discharged from the reactor into a product container and filtered through a 5 micron pore size polypropylene filter bag.

There resulted a stabilized wax dispersion comprised of about 18.7 weight percent of the above stearyl stearamide wax and about 0.5 percent by weight of the above anionic surfactant as measured gravimetrically utilizing a hot plate where the ratio of the resin to wax was about 2.5 parts per hundred as determined by liquid chromatography, capillary electrophoresis and gas chromatography. The wax particles of the dispersion possessed a volume median diameter of about 188 nanometers and volume 90th percentile diameter of about 292 nanometers as determined by a Microtrac UPA150 particle size analyzer. The aforementioned product dispersion was stable, that is the wax did not settle from the dispersion and there was an absence of settled wax after six months of storage.

EXAMPLE II

Preparation of a Sodiosulfonated Polyester:

A linear sulfonated random copolyester resin comprised of, on a mol percent, 0.465 of terephthalate, 0.035 of sodium sulfoisophthalate, 0.475 of 1,2-propanediol, and 0.025 of diethylene glycol was prepared as follows. In a 5 gallon Parr reactor equipped with a bottom drain valve, double turbine agitator, and distillation receiver with a cold water condenser were charged 3.98 kilograms of dimethylterephthalate, 451 grams of sodium dimethyl sulfoisophthalate, 3.104 kilograms of 1,2-propanediol (1 mole excess of glycol), 351 grams of diethylene glycol (1 mole excess of glycol), and 8 grams of butyltin hydroxide oxide catalyst. The reactor was then heated to 165° C. with stirring for 3 hours whereby 1.33 kilograms of distillate were collected in the distillation receiver, and which distillate was comprised of about 98 percent by volume of methanol and 2 percent by volume of 1,2-propanediol as measured by the ABBE refractometer available from American Optical Corporation. The reactor mixture was then heated to 190° C. over a one hour period, after which the pressure was slowly reduced from atmospheric pressure to about 260 Torr over a one hour period, and then reduced to 5 Torr over a two hour period with the collection of approximately 470 grams of distillate in the distillation receiver, and which distillate was comprised of approximately 97 percent by volume of 1,2-propanediol and 3 percent by volume of methanol as measured by the ABBE refractometer. The pressure was then further reduced to about 1 Torr over a 30 minute period whereby an additional 530 grams of 1,2-propanediol were collected. The reactor was then purged with nitrogen to atmospheric pressure, and the polymer product discharged through the bottom drain onto a container cooled with dry ice to yield 5.60 kilograms of a 3.5 mol percent sulfonated polyester resin sodio salt of (1,2-propylene-dipropylene-5-sulfoisophthalate)-copoly (1,2-propylene-dipropylene terephthalate). The sulfonated polyester resin glass transition temperature was measured to be 56.6° C. (onset) utilizing the 910 Differential Scanning Calorimeter available from E. I. DuPont operating at a heating rate of 10° C. per minute. The number average molecular weight was measured to be 3,250 grams per mole, and the weight average molecular weight was measured to be 5,290 grams per mole using tetrahydrofuran as the solvent.

EXAMPLE III

Preparation of a Sodiosulfonated Polyester Colloid Solution:

A 15 percent solids concentration of a colloidal sulfonate polyester resin dissipated in an aqueous media was prepared by first heating about 2 liters of deionized water to about 85° C. with stirring, and adding thereto 300 grams of the sulfonated polyester resin obtained above in Example II, followed by continued heating at about 85° C., and stirring of the mixture resulting for a duration of from about one to about two hours, followed by cooling to about room temperature, about 23° C. to about 25° C. throughout the Examples. The colloidal solution of the sodiosulfonated polyester resin particles possessed a characteristic blue tinge and a particle size of 40 nanometers, as measured by the NiCOMP particle sizer.

EXAMPLE IV

Toner Comprised of 85 Percent Sulfonated Polyester Resin, 9 Percent KEMAMIDE™ S180 Wax and 6 Percent Pigment Blue 15:3 Colorant:

A 4 liter kettle equipped with a mechanical stirrer was charged with 2,000 milliliters of an aqueous solution of the sulfonated polyester resin emulsion of Example III. To this dispersion was then added 6 percent by weight of FLEXIVERSE™ Cyan 15:3 pigment dispersion and 9 percent by weight of the KEMAMIDE™ S180 wax dispersion of Example I. The mixture resulting was then stirred at 225 rpm and heated to 56° C. followed by the addition of 12.5 percent of zinc acetate (to initiate aggregation and coalescence) as a 3 percent aqueous solution of zinc acetate over a 3 hour period. The mixture obtained was then further heated to 58° C. until a toner particle size of 5.7 microns (GSD=1.19) was obtained. The reactor was then cooled down to room temperature (about 22° C. to about 25° C.) and the resulting particles were washed 3 times with deionized water. The particles were then dried on a freeze dryer at a temperature of −80° C. for a period of 3 days. There resulted a toner comprised of 85 percent (weight percent) of the above sulfonated polyester resin, 9 percent of KEMAMIDE™ S180 Wax and 6 percent of Pigment Blue 15:3 colorant.

A toner image was then prepared in the Xerox Corporation Document Centre 265ST printer and which image was fused at 194 mm/s onto Color Xpressions (90 gsm) paper to determine gloss and crease; hot offset performance was printed on S paper (60 gsm) and with the fuser operating at 104 mm/s. The toner of this Example displayed a minimum fixing temperature of 154° C., a Hot-Offset Temperature of 170° C. and a peak gloss of 77 Gardner units.

EXAMPLE V

Toner Comprised of 82 Percent Sulfonated Polyester Resin, 12 Percent KEMAMIDE™ S180 Wax and 6 Percent Pigment Blue 15:3 Colorant:

A 4 liter kettle equipped with a mechanical stirrer was charged with 2,000 milliliters of an aqueous solution of the sulfonated polyester resin emulsion of Example III. To this dispersion was then added 6 percent by weight of the above FLEXIVERSE™ Cyan 15:3 pigment dispersion and 12 percent by weight of the KEMAMIDE™ S180 wax dispersion of Example I. The mixture was then stirred at 225 rpm and heated to 56° C. followed by the addition of 12.5 percent of zinc acetate as a 3 percent aqueous solution of zinc acetate over a 3 hour period. The mixture was then further heated to 58° C. until a toner particle size of 5.8 microns (GSD of 1.2) was obtained. The reactor was then cooled down to room temperature (about 22° C. to about 25° C.) and the resulting particles were washed 3 times with deionized water. The particles were then dried on a freeze dryer at a temperature of −80° C. for a period of 3 days.

A toner image was prepared using the Xerox Corporation Document Centre 265ST printer and fused at 194 mm/s onto Color Xpressions (90 gsm) paper to determine gloss and crease; hot offset performance was examined printed on S paper (60 gsm) and with the fuser operating at 104 mm/s. The toner of this example displayed a minimum fixing temperature of 152° C., a Hot-Offset temperature of 185° C. and peak gloss of 76 Gardner units.

EXAMPLE VI

Toner Comprised of 79 Percent Sulfonated Polyester Resin, 15 Percent KEMAMIDE™ S180 Wax and 6 Percent Pigment Blue 15:3 Colorant:

A 4 liter kettle equipped with a mechanical stirrer was charged with 2,000 milliliters of an aqueous solution of a sulfonated polyester resin emulsion of Example III. To this dispersion was then added 6 percent by weight of FLEXIVERSE™ Cyan 15:3 pigment dispersion and 15 percent by weight of the KEMAMIDETM™ S180 wax dispersion of Example I. The mixture was then stirred at 225 rpm and heated to 56° C. followed by the addition of 12.5 percent of zinc acetate to resin as a 3 percent aqueous solution of zinc acetate over a 3 hour period. The mixture was then further heated to 58° C. until a toner particle size of 5.8 microns (GSD=1.25) was obtained. The reactor was then cooled down to room temperature (about 22° C. to about 25° C.) and the resulting particles were washed 3 times with deionized water. The particles were then dried on a freeze dryer at a temperature of −80° C. for a period of 3 days.

A toner image was prepared using the Xerox Corporation Document Centre 265ST printer and which image was fused at 194 mm/s onto Color Xpressions (90 gsm) paper to determine gloss and crease; hot offset performance was examined printed on S paper (60 gsm) and with the fuser operating at 104 mm/s. The toner of this Example displayed a minimum fixing temperature of 148° C., a Hot-Offset temperature of 185° C. and peak gloss of 77 Gardner units.

COMPARATIVE EXAMPLE VII

Toner Comprised of 94 Percent Sulfonated Polyester Resin, and 6 Percent Pigment Blue 15:3 Colorant:

A 4 liter kettle equipped with a mechanical stirrer was charged with 2,000 milliliters of an aqueous solution of a sulfonated polyester resin emulsion of Example III. To this dispersion was then added 6 percent by weight of FLEXIVERSE™ Cyan 15:3 pigment dispersion. The mixture was then stirred at 225 rpm and heated to 56° C. followed by the addition of 12.5 percent of zinc acetate to resin as a 3 percent aqueous solution of zinc acetate over a 3 hour period. The mixture was then further heated to 58° C. until a toner particle size of 5.7 microns (GSD=1.21) was obtained. The reactor was then cooled down to room temperature (about 22° C. to about 25° C.) and the resulting particles were washed 3 times with deionized water. The particles were then dried on a freeze dryer at a temperature of −80° C. for a period of 3 days.

A toner image was prepared using the Xerox Corporation Document Centre 265ST printer and which image was fused at 194 mm/s onto Color Xpressions (90 gsm) paper to determine gloss and crease; hot offset performance was examined printed on S paper (60 gsm) and with the fuser operating at 104 mm/s. The toner of this Example displayed a minimum fixing temperature of 152° C., a Hot-Offset temperature of 150° C. and peak gloss of 70 Gardner units. Note, that without the use of alkyl amide, the toner image was found to offset at about the fixing temperature of the toner, and resulting with no fusing latitude.

COMPARATIVE EXAMPLE VIII

Toner Comprised of 85 Percent Sulfonated Polyester Resin, 9 Percent Carnauba Wax and 6 Percent Pigment Blue 15:3 Colorant:

A 4 liter kettle equipped with a mechanical stirrer was charged with 2,000 milliliters of an aqueous solution of a sulfonated polyester resin emulsion of Example III. To this dispersion was then added 6 percent by weight of FLEXIVERSE™ Cyan 15:3 pigment dispersion, and 9 percent of Carnauba wax aqueous emulsion (10 percent solids by weight), and available from Michelmann International. The mixture was then stirred at 225 rpm and heated to 56° C. followed by the addition of 12.5 percent zinc acetate to resin as a 3 percent aqueous solution of zinc acetate over a 3 hour period. The mixture was then further heated to 58° C. until a toner particle size of 5.7 microns (GSD=1.21) was obtained. The reactor was then cooled down to room temperature (about 22° C. to about 25° C.) and the resulting particles were washed 3 times with deionized water. The particles were then dried on a freeze dryer at a temperature of −80° C. for a period of 3 days.

A toner image was prepared using the Xerox Corporation Document Centre 265ST printer and which image was fused at 194 mm/s onto Color Xpressions (90 gsm) paper to determine gloss and crease while hot offset performance was examined printed on S paper (60 gsm) and with the fuser operating at 104 mm/s. The toner of this example displayed a minimum fixing temperature of 152° C. a Hot-Offset Temperature of 180° C. and peak gloss of 40 Gardner units. Note, that utilizing a wax, such as Carnauba wax, for release instead of the use of alkyl amide, the toner image was found to give lower gloss of about 40 Gardner units as compared to over 70 or higher when the alkyl amides are used as in the aforementioned Examples IV to VI.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A toner comprised of a sulfopolyester resin, a colorant and alkyl amide; wherein the alkyl amide is stearyl stearamide; and wherein said sulfopolyester is selected from the group consisting of the sodium or lithium salt of copoly(1,2-propylene-dipropylene-5-sulfoisophthalate)-copoly (1,2-propylene-dipropylene terephthalate), copoly(1,2-propylene-d iethylene-5-sulfoisophthalate)-copoly(1,2-propylene-diethylene terephthalate), copoly(1,2-dipropylene-5-sulfoisophthalate)-copoly(1,2-propylene terephthalate), copoly(1,3-butylene-5-sulfoisophthalate)-copoly (1,3-butyleneterephthalate), copoly(1,2 dipropylene-5-sulfoisophthalate)-copoly(1,2-propylene terephthalate), copoly(1,3-butylene-5-sulfoisophthalate)-copoly(1,3-butylene terephthalate), and copoly(1,2-propylene-diethylene-5-sulfoisophthalate)-copoly(1,2-propylene-diethylene terephthalate).

2. A toner in accordance to claim 1 wherein said sulfopolyester resin possesses a number average molecular weight of from about 2,000 grams per mole to about 100,000 grams per mole, a weight average molecular weight of from about 4,000 grams per mole to about 250,000 grams per mole, and a polydispersity of from about 1.8 to about 17 as measured by gel permeation chromatography.

3. A toner in accordance with claim 1 wherein the colorant is carbon black.

4. A toner in accordance with claim 1 wherein the colorant is cyan, magenta, yellow, black, or mixtures thereof.

5. A toner in accordance with claim 1 wherein the sulfopolyester resin is selected in an amount of from about 75 to about 90 weight percent of the toner, the colorant is selected in an amount of from about 3 to about 15 weight percent of the toner, the alkyl amide is selected in an amount of from about 5 to about 20 percent by weight, and wherein the total of said components is 100 weight percent of the toner.

6. A toner in accordance to claim 1 wherein the sulfopolyester resin is the sodium salt of copoly(1,2-propylene-dipropylene-5-sulfoisophthalate)-copoly(1,2-propylene-dipropylene terephthalate) or lithium salt of copoly(1,2-propylene-diethylene-5-sulfoisophthalate)-copoly (1,2-propylene-diethylene terephthalate) in an amount of from about 70 to about 75 weight percent of toner; the alkylamide is stearyl stearamide in an amount of from about 10 to about 15 weight percent, and the colorant is cyan, black, magenta or yellow, each present in an amount of from about 5 to about 12 weight percent of toner.

7. A developer comprised of the toner of claim 1 and carrier.

8. A toner in accordance with claim 1 wherein said sulfopolyester is the sodium salt of copoly(1,2-propylene-dipropylene-5-sulfoisophthalate)-copoly(1,2-propylene-dipropylene terephthalate).

9. A toner comprised of a sulfopolyester resin, a colorant and an alkyl amide; wherein the alkyl amide is stearyl stearamide; and wherein the sulfopolyester resin has a glass transition temperature of from about 50° C. to about 65° C.

10. A developer comprised of the toner of claim 9 and carrier.

11. A toner comprising a sulfopolyester resin, a colorant and an alkyl amide;

wherein the alkyl amide is stearyl stearamide; and wherein the sulfopolyester resin possesses a number average molecular weight of from about 20,000 grams per mole to about 75,000 grams per mole, a weight average molecular weight of from about 25,000 grams per mole to about 125,000 grams per mole, and a polydispersity of from about 1.8 to about 17 as measured by gel permeation chromatography.

* * * * *